US010081517B1

(12) United States Patent
Cheng

(10) Patent No.: US 10,081,517 B1
(45) Date of Patent: Sep. 25, 2018

(54) MECHANISM FOR LINKING CHAIR AND FOOTREST OF STAIRLIFT TO EACH OTHER

(71) Applicant: MERITS HEALTH PRODUCTS CO., LTD., Taichung (TW)

(72) Inventor: Ming-Chuan Cheng, Taichung (TW)

(73) Assignee: Merits Health Products Co., Ltd., Taichung (TW)

( * ) Notice: Subject to any disclaimer, the term of this patent is extended or adjusted under 35 U.S.C. 154(b) by 0 days.

(21) Appl. No.: 15/468,998

(22) Filed: Mar. 24, 2017

(51) Int. Cl.

| | |
|---|---|
| ***A47C 7/62*** | (2006.01) |
| ***A47C 31/00*** | (2006.01) |
| ***B66B 9/08*** | (2006.01) |
| ***A47C 1/00*** | (2006.01) |
| ***A47C 7/50*** | (2006.01) |
| ***A47C 7/56*** | (2006.01) |

(52) U.S. Cl.
CPC ..... *B66B 9/08* (2013.01); *A47C 1/00* (2013.01); *A47C 7/506* (2013.01); *A47C 7/56* (2013.01); *B66B 2009/0892* (2013.01)

(58) Field of Classification Search
CPC . B66B 9/08; B66B 9/0853; B66B 2009/0892; A47C 1/00; A47C 7/506; A47C 7/56; A47C 7/00; A47C 7/50; A61G 5/061; A61G 5/10; A61G 5/12; A61G 5/125; A61G 5/128; A61G 2005/125; A61G 2005/128
USPC ..... 297/217.7, 30
See application file for complete search history.

(56) References Cited

U.S. PATENT DOCUMENTS

| | | | | | |
|---|---|---|---|---|---|
| 2,888,099 | A * | 5/1959 | Hoffmann | B66B 5/04 | 187/202 |
| 4,174,023 | A * | 11/1979 | Dooley | B66B 9/0823 | 187/201 |
| 4,913,264 | A * | 4/1990 | Voves | B66B 9/08 | 187/201 |
| 5,533,594 | A * | 7/1996 | Tremblay | B66B 9/0838 | 187/201 |
| 5,695,239 | A * | 12/1997 | Johnson | A47C 7/506 | 297/423.25 |
| 5,890,766 | A * | 4/1999 | Tsai | A47C 7/506 | 297/423.28 |
| 6,196,631 | B1 * | 3/2001 | Larson | A47C 7/506 | 297/423.26 |

(Continued)

*Primary Examiner* — Mark R Wendell
(74) *Attorney, Agent, or Firm* — Muncy, Geissler, Olds & Lowe, P.C.

(57) ABSTRACT

A mechanism for linking a chair and a footrest of a stairlift to each other includes: a base; a chair mounted on the base and having a seat swingably connected to the base and a cord control portion; a footrest having a plate pivotally connected to the base; a link unit having a first link and a footrest pivotal portion for driving the footrest to swing, wherein the first link has a base pivotal connection portion pivotally connected to the base, a cord-penetrable portion, and a spring-hooked portion; a control cable having a cord penetrating the cord-penetrable portion, wherein the cord has a first end connected to the cord control portion of the chair, a second end, and a link-pressing portion for pressing against the cord-penetrable portion; and a cable-connected spring with two ends hooked to the base and the second end of the control cable, respectively.

14 Claims, 6 Drawing Sheets

(56) References Cited

U.S. PATENT DOCUMENTS

| | | | | |
|---|---|---|---|---|
| 7,347,497 | B2 * | 3/2008 | Fujihara | A61G 5/12 280/304.1 |
| 9,758,348 | B2 * | 9/2017 | Woodhams | B66B 9/08 |
| 9,776,830 | B2 * | 10/2017 | Ooms | B66B 9/08 |
| 2008/0203775 | A1 * | 8/2008 | Caroen | B66B 9/08 297/30 |
| 2010/0013280 | A1 * | 1/2010 | Groll | A47C 9/025 297/217.7 |

* cited by examiner

MECHANISM FOR LINKING CHAIR AND FOOTREST OF STAIRLIFT TO EACH OTHER

BACKGROUND OF THE INVENTION

1. Field of the Invention

The present invention relates to exercise equipment and, more particularly, to a mechanism for linking a chair and a footrest of a stairlift to each other.

2. Description of the Prior Art

Conventional mechanisms for linking a chair and a footrest of a stairlift to each other control motion of a seat of the chair and the footrest with links, allowing the seat and the footrest to move together only, that is, the seat and the footrest swing upward together and swing downward together. As a result, the united upward swing and united downward swing of the seat and the footrest fails to meet user needs. Therefore, the conventional mechanisms for linking a chair and a footrest of a stairlift to each other still have room for improvement.

SUMMARY OF THE INVENTION

In view of the aforesaid drawbacks of the prior art, it is an objective of the present invention to provide a mechanism for linking a chair and a footrest of a stairlift to each other, and the mechanism controls the swing of a seat of the chair and the swing of the footrest, respectively, thereby meeting user needs.

In order to achieve the above and other objectives, the present invention provides a mechanism for linking a chair and a footrest of a stairlift to each other, the mechanism comprising: a base; a chair mounted on the base and having a seat swingably connected to the base and a cord control portion; a footrest having a plate pivotally connected to the base; a link unit having a first link and a footrest pivotal portion for driving the footrest to swing, wherein the first link has a base pivotal connection portion pivotally connected to the base, a cord-penetrable portion, and a spring-hooked portion; a control cable having a cord penetratingly disposed at the cord-penetrable portion of the first link, wherein the cord has a first end connected to the cord control portion of the chair, a second end, and a link-pressing portion for pressing against the cord-penetrable portion of the first link; and a cable-connected spring with an end hooked to the base and another end hooked to the second end of the control cable.

Preferably, the link unit further has a second link with an end pivotally connected to an end of the first link and positioned distal to the base pivotal connection portion, and the footrest pivotal portion is disposed at the second link.

Preferably, the mechanism further comprises a link-connected spring with two ends hooked to the base and the spring-hooked portion of the first link, respectively.

Preferably, the mechanism further comprises a reel for winding the cord of the control cable.

Preferably, the footrest has a linking arm, and the linking arm is connected to the plate.

Preferably, the control cable has an outer pipe, and the cord is penetratingly disposed in the outer pipe.

DETAILED DESCRIPTION OF THE EMBODIMENT OF THE INVENTION

Figure 1:
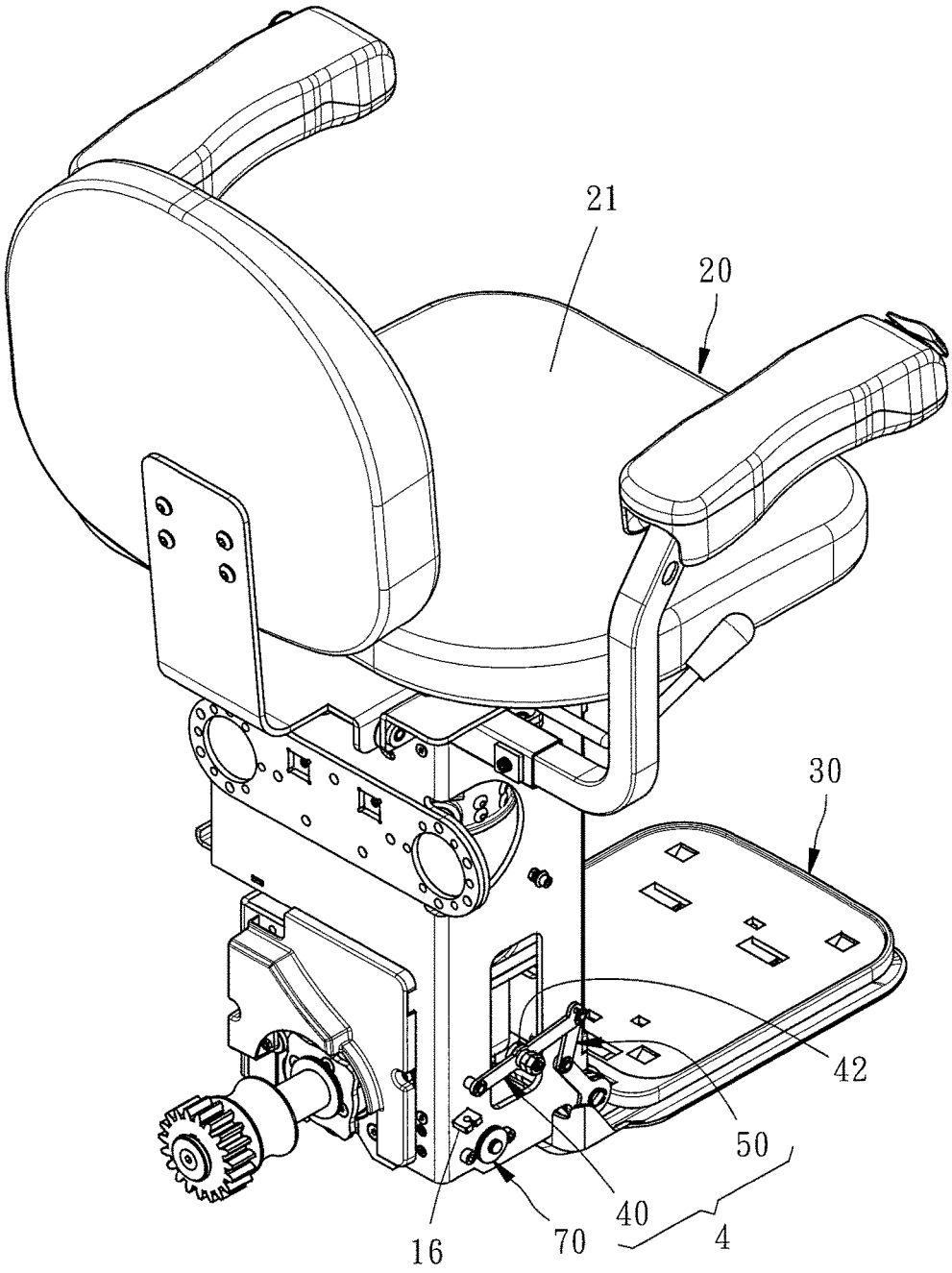
FIG. 1 is a perspective view of a mechanism for linking a chair and a footrest of a stairlift to each other according to a preferred embodiment of the present invention.

The present invention is further explained by the accompanying diagrams and an embodiment.

As shown in the diagrams, a mechanism for linking a chair and a footrest of a stairlift to each other, as provided by the present invention, comprises a base 10, a chair 20, a footrest 30, a first link 40, a second link 50, a control cable 60, a reel 70, a cable-connected spring 80, and a link-connected spring 90.

The base 10 has a cable holding portion 16.

The chair 20 is mounted on the base 10. The chair 20 not only has a seat 21 swingably connected to the base 10 but also has a cord control portion 26.

The footrest 30 has a plate 31 pivotally connected to the base 10 and a linking arm 32 fixedly connected to the plate 31.

The first link 40 has a base pivotal connection portion 41 pivotally connected to the base 10, a cord-penetrable portion 42, and a spring-hooked portion 43.

The second link 50 has one end pivotally connected to the first link 40 and positioned distal to the base pivotal connection portion 41, and the other end with a footrest pivotal portion 53 pivotally connected to the linking arm 32 of the footrest 30. The footrest pivotal portion 53 drives the footrest 30 to swing.

The first link 40 and the second link 50 constitute a link unit 4; hence, the link unit 4 generally comprises the first link 40, the second link 50, and components thereof.

The control cable 60 has a cord 61 penetratingly disposed at the cord-penetrable portion 42 of the first link 40. The cord 61 has a first end 611 connected to the cord control portion 26 of the chair 20. The cord 61 has a second end 612 and a link-pressing portion 613 which presses against the cord-penetrable portion 42 of the first link 40. The cord 61 is penetratingly disposed in the outer pipe 62 of the control cable 60.

The reel 70 is used for winding the cord 61 of the control cable 60.

The cable-connected spring 80 has one end hooked to the base 10 and the other end hooked to the second end 612 of the control cable 60.

The link-connected spring 90 has two ends hooked to the base 10 and the spring-hooked portion 43 of the first link 40, respectively.

The cable-connected spring 80 is closer to the base pivotal connection portion 41 of the first link 40 than the link-connected spring 90. The cable-connected spring 80 is of a smaller length than the link-connected spring 90.

Figure 2:
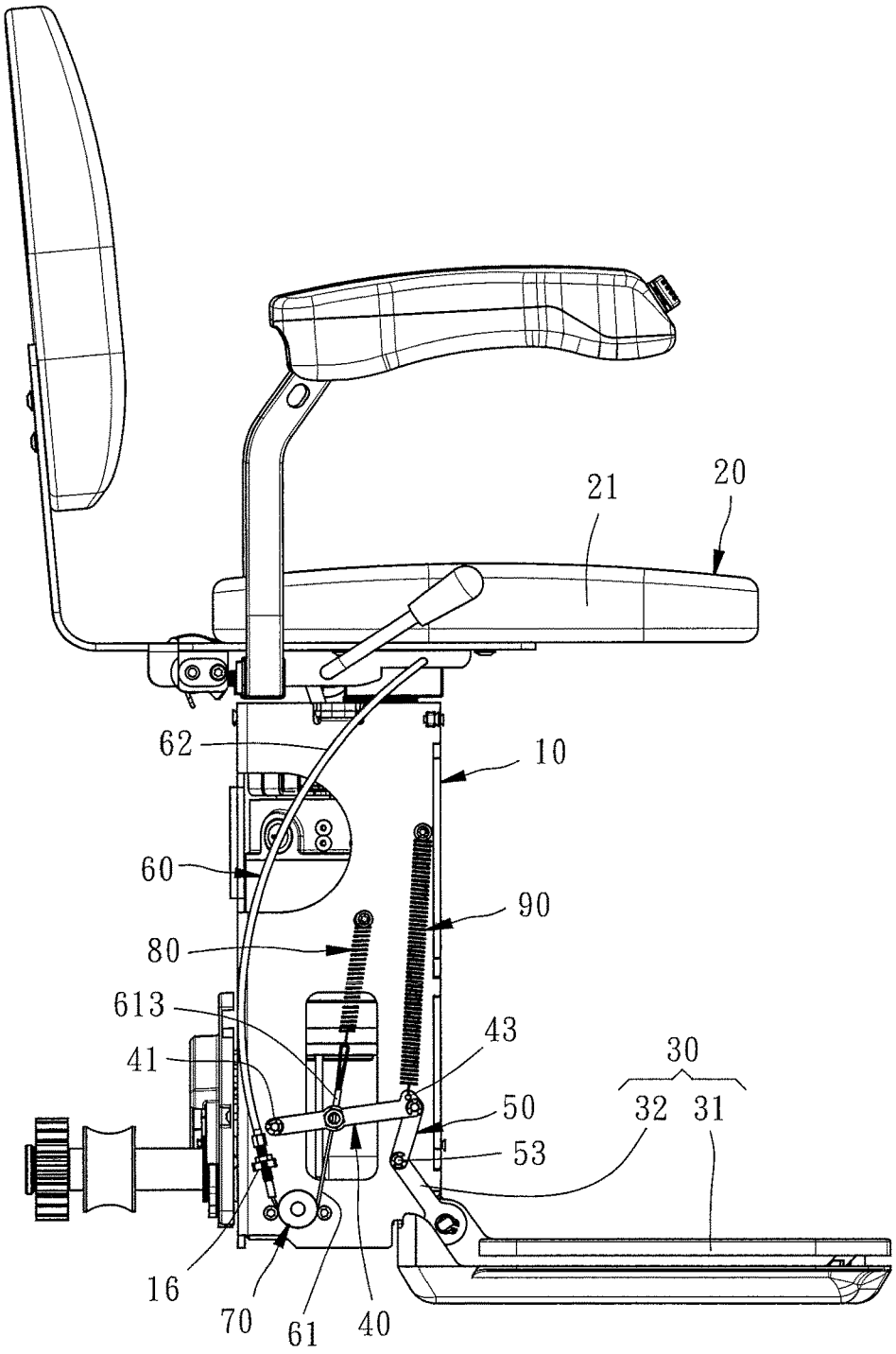
FIG. 2 is a schematic view of a status of the mechanism according to a preferred embodiment of the present invention, showing that neither the chair nor the footrest has swung.
Figure 3:
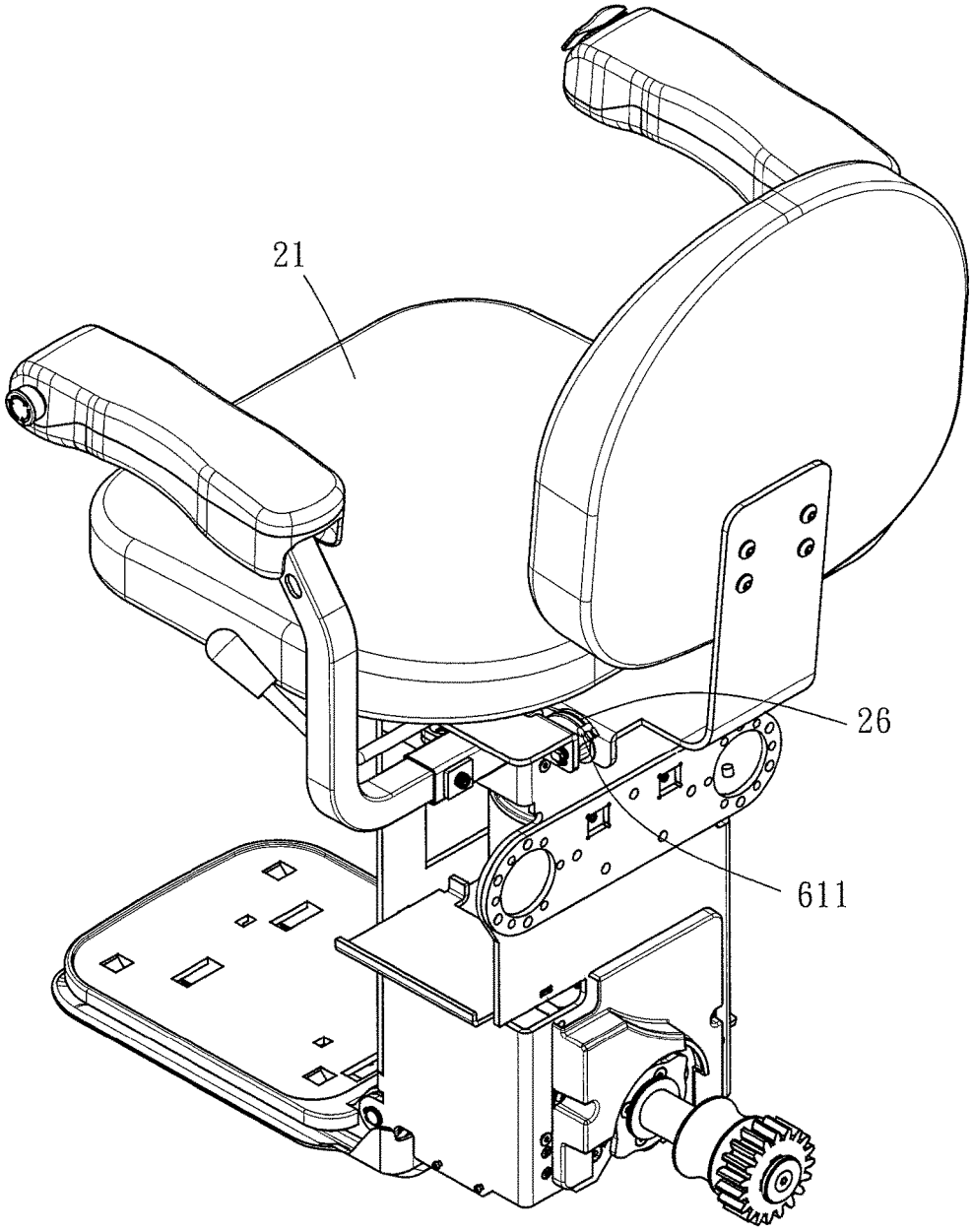
FIG. 3 is a partial perspective view of the mechanism according to a preferred embodiment of the present invention, showing how a seat and a cord are connected.

When the seat 21 has not yet swung upward, the footrest 30 is available to a user, because of the cable-connected spring 80 which pulls the control cable 60 and the link-connected spring 90 which pulls the first link 40, as shown in FIG. 2.

Figure 4:
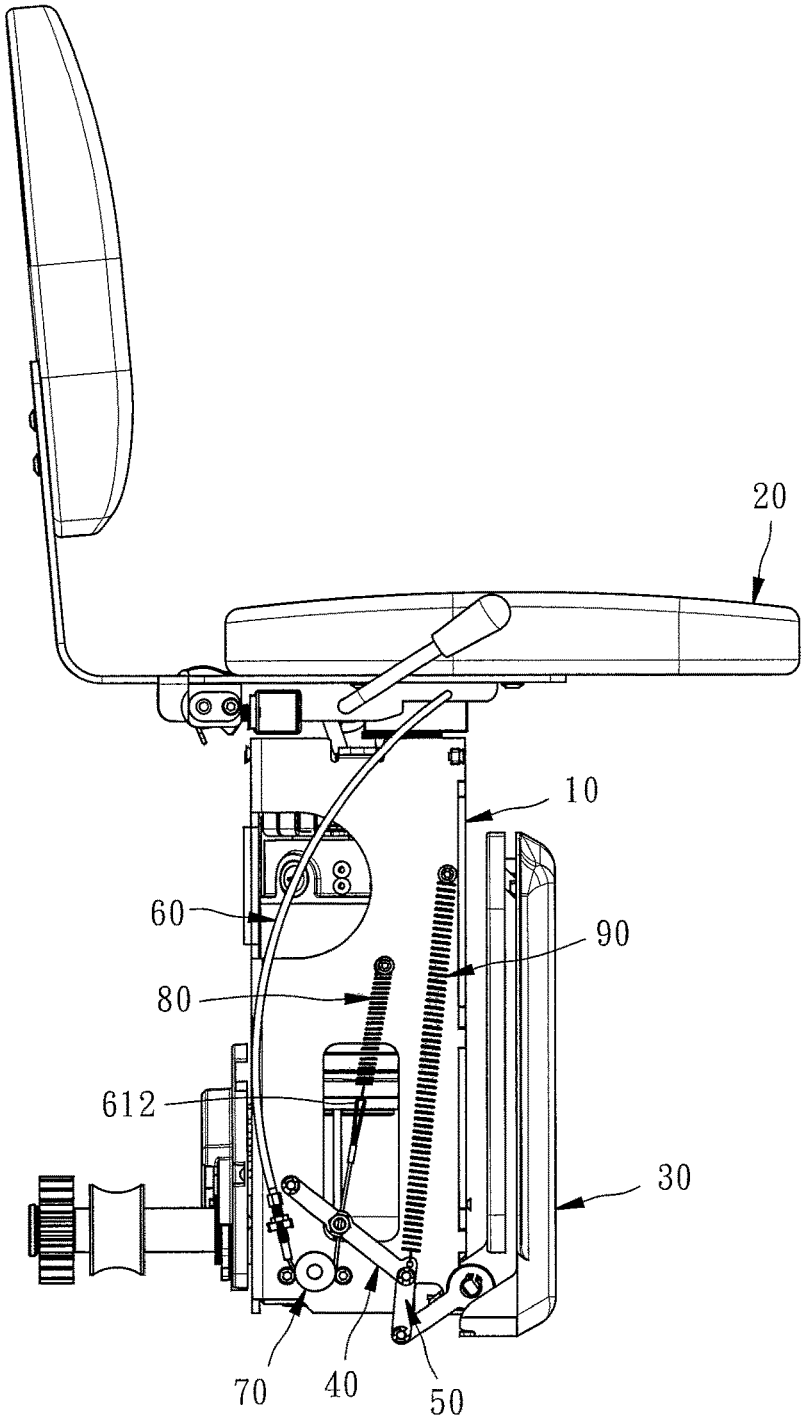
FIG. 4 is a schematic view of another status of the mechanism according to a preferred embodiment of the present invention, showing that the footrest has swung but the chair has not.

To swing the footrest 30 upward while not allowing the seat 21 to swing upward, it is feasible for the linking arm 32 of the footrest 30 to drive the first link 40 to swing downward and stretch the link-connected spring 90, leaving the cable-connected spring 80 unmoved, as shown in FIG. 4.

Figure 5:
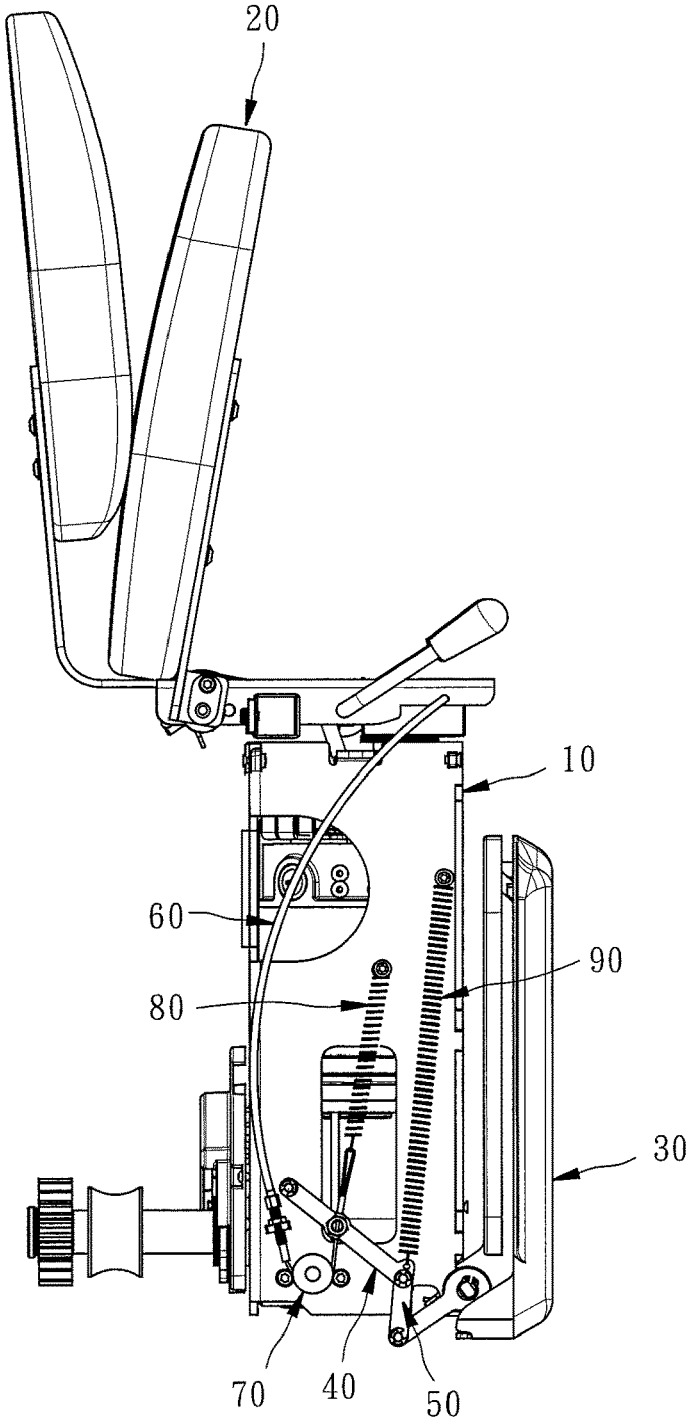
FIG. 5 is a schematic view of yet another status of the mechanism according to a preferred embodiment of the present invention, showing that both the chair and the footrest have swung.
Figure 6:
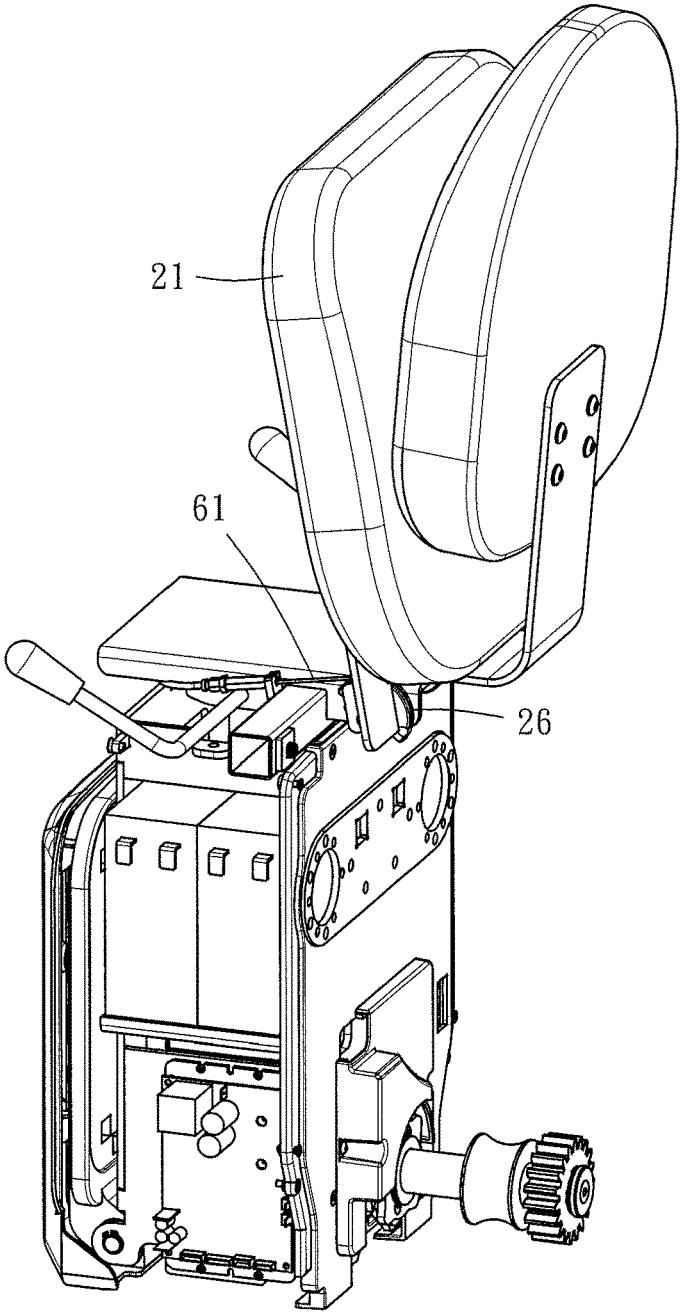
FIG. 6 is a partial perspective view of the mechanism according to a preferred embodiment of the present invention, showing how the seat and the cord are connected.

In the aforesaid two states, the user may operate the mechanism in a manner to enable the seat 21 to swing upward so that the cord control portion 26 of the chair 20 pulls the cord 61 and thereby stretches the cable-connected spring 80. Therefore, the link-pressing portion 613 presses against the cord-penetrable portion 42 and thereby enables the first link 40 to swing. At this point in time, the linking arm 32 of the footrest 30 drives the first link 40 to swing downward and stretches the link-connected spring 90, thereby allowing the footrest 30 to swing upward, as shown in FIG. 5 and FIG. 6.

In addition to the aforesaid embodiment, the present invention is illustrated by a variant embodiment described below.

For instance, the reel 70 of the mechanism of the present invention is optional.

Alternatively, the second link 50 of the mechanism of the present invention is optional, as it is feasible that the linking arm 32 of the footrest 30 is pivotally connected to the first link 40 to thereby achieve the objectives of the present invention.

Alternatively, the cord-penetrable portion 42 is not necessarily fixed in place relative to the first link 40, as it is feasible for the cord-penetrable portion 42 to slide and move relative to the first link 40 to thereby render overall motion smooth.

In conclusion, the present invention enables users to control the swings of the seat 21 and the footrest 30 in a manner to meet various user needs, thereby achieving the objectives of the present invention.

The preferred embodiments of the present invention are described above in length. Understandably, persons skilled in the art can make plenty changes and variations to the concepts embodied in the present invention without making any creative effort. Hence, all technical solutions put forth by persons skilled in the art in accordance with the concepts embodied in the present invention, as well as the prior art, and by logical analyses, inferences, or finite experiments shall be deemed falling within the scope of the appended claims.

What is claimed is:

1. A mechanism for linking a chair and a footrest of a stairlift to each other, the mechanism comprising:

a base;

a chair mounted on the base and having a seat swingably connected to the base and a cord control portion;

a footrest having a plate pivotally connected to the base;

a link unit having a first link and a footrest pivotal portion for driving the footrest to swing, wherein the first link has a base pivotal connection portion pivotally connected to the base, a cord-penetrable portion, and a spring-hooked portion;

a control cable having a cord penetratingly disposed at the cord-penetrable portion of the first link, wherein the cord has a first end connected to the cord control portion of the chair, a second end, and a link-pressing portion for pressing against the cord-penetrable portion of the first link;

a cable-connected spring with an end hooked to the base and another end hooked to the second end of the control cable, and a link-connected spring with two ends hooked to the base and the spring-hooked portion of the first link, respectively.

2. The mechanism of claim 1, wherein the link unit further has a second link with an end pivotally connected to an end of the first link and positioned distal to the base pivotal connection portion, wherein the footrest pivotal portion is disposed at the second link.

3. The mechanism of claim 1, further comprising a reel for winding the cord of the control cable.

4. The mechanism of claim 3, wherein the footrest has a linking arm, and the linking arm is connected to the plate.

5. The mechanism of claim 4, wherein the control cable has an outer pipe, and the cord is penetratingly disposed in the outer pipe.

6. The mechanism of claim 3, wherein the control cable has an outer pipe, and the cord is penetratingly disposed in the outer pipe.

7. The mechanism of claim 1, wherein the footrest has a linking arm, and the linking arm is connected to the plate.

8. The mechanism of claim 1, wherein the control cable has an outer pipe, and the cord is penetratingly disposed in the outer pipe.

9. A mechanism for linking a chair and a footrest of a stairlift to each other, the mechanism comprising:

a base;

a chair mounted on the base and having a seat swingably connected to the base and a cord control portion;

a footrest having a plate pivotally connected to the base;

a link unit having a first link and a footrest pivotal portion for driving the footrest to swing, wherein the first link has a base pivotal connection portion pivotally connected to the base, a cord-penetrable portion, and a spring-hooked portion;

a control cable having a cord penetratingly disposed at the cord-penetrable portion of the first link, wherein the cord has a first end connected to the cord control portion of the chair, a second end, and a link-pressing portion for pressing against the cord-penetrable portion of the first link;

a cable-connected spring with an end hooked to the base and another end hooked to the second end of the control cable; and a reel for winding the cord of the control cable.

10. The mechanism of claim 9, wherein the link unit further has a second link with an end pivotally connected to an end of the first link and positioned distal to the base pivotal connection portion, wherein the footrest pivotal portion is disposed at the second link.

11. The mechanism of claim 10, further comprising a link-connected spring with two ends hooked to the base and the spring-hooked portion of the first link, respectively.

12. The mechanism of claim 9, wherein the footrest has a linking arm, and the linking arm is connected to the plate.

13. The mechanism of claim 12, wherein the control cable has an outer pipe, and the cord is penetratingly disposed in the outer pipe.

14. The mechanism of claim 9, wherein the control cable has an outer pipe, and the cord is penetratingly disposed in the outer pipe.

* * * * *